US005154045A

United States Patent [19]

Saruwatari et al.

[11] Patent Number: 5,154,045

[45] Date of Patent: Oct. 13, 1992

[54] SUCTION CLEANING SYSTEM AND DUCTING FOR SPINNING MACHINES

[75] Inventors: Yoshinori Saruwatari, Nagoya; Osamu Yoshida, Gifu; Hiroshi Enomoto, Ama; Chikaji Ohmori, Ichinomiya, all of Japan

[73] Assignee: Howa Machinery, Ltd., Aichi, Japan

[21] Appl. No.: 512,102

[22] Filed: Apr. 20, 1990

[30] Foreign Application Priority Data

Apr. 25, 1989 [JP] Japan ..... 1-105649

[51] Int. Cl.[5] ..... D01H 11/00

[52] U.S. Cl. ..... 57/304; 15/301

[58] Field of Search ..... 57/300-302, 57/304, 307, 308; 15/301, 312.1; 55/293, 294, 273

[56] References Cited

U.S. PATENT DOCUMENTS

| | | | |
|---|---|---|---|
| 2,613,611 | 10/1952 | Simon | 15/312.1 |
| 2,717,484 | 10/1955 | Hofstetter | 15/301 X |
| 2,976,668 | 3/1961 | Reiterer | 15/301 X |
| 2,977,181 | 3/1961 | Reiterer | 15/301 X |
| 3,018,603 | 1/1962 | Rutz et al. | 15/301 X |
| 3,486,309 | 12/1969 | Wild | 15/301 X |
| 3,589,520 | 6/1971 | Thorne | 55/293 X |
| 3,762,143 | 10/1973 | Stewart | 15/301 X |
| 3,782,095 | 1/1974 | Bwes et al. | 57/304 X |
| 4,087,888 | 5/1978 | Tanaka | 15/301 X |
| 4,947,509 | 8/1990 | Dinkelmann | 57/304 X |

FOREIGN PATENT DOCUMENTS

| | | |
|---|---|---|
| 1510590 | 2/1970 | Fed. Rep. of Germany . |
| 1685860 | 10/1971 | Fed. Rep. of Germany . |
| 2644274 | 4/1977 | Fed. Rep. of Germany . |
| 346076 | 10/1955 | Japan . |
| 3813925 | 10/1959 | Japan . |
| 62-62936 | 8/1987 | Japan . |

*Primary Examiner*—Joseph J. Hail, III

*Attorney, Agent, or Firm*—Stevens, Davis, Miller & Mosher

[57] ABSTRACT

In an apparatus for cleaning a spinning frame provided with a plurality of draft units, a plurality of cleaning units, each provided with an element for creating an air suction force, are disposed adjacent to and below the alignment of draft units in such a manner that each cleaning unit is able to suck flys deposited around a group of the draft units, a main duct is disposed adjacent to and below the alignment of the cleaning units and extended for entire length of the spinning frame, and a filter box is connected to a terminal end of the main duct, each cleaning unit is connected to the main duct, and the main duct is provided with an element allowing a passage of a part of air discharged from each cleaning unit, except at the cleaning unit located farthest from the filter box, whereby the air suction force created by each cleaning unit can be maintained at a uniform value, this apparatus is also provided with an element for cleaning files deposited on the bottom of the main duct, at predetermined intervals, to maintain the function thereof.

7 Claims, 11 Drawing Sheets

SUCTION CLEANING SYSTEM AND DUCTING FOR SPINNING MACHINES

BACKGROUND OF THE INVENTION

1. Field of the Invention

The present invention relates to an apparatus for cleaning a spinning frame, more particularly to an apparatus for cleaning roller parts such as draft parts of a spinning frame, to remove fibers deposited thereon, by a pneumatic cleaning action.

2. Description of the Related Art

Several apparatus as for cleaning a spinning frame by a pneumatic cleaning action have been developed and are utilized in spinning factories, as disclosed in, for example, Japanese Examined Patent Publication Showa 34 (1959)-6076, Japanese Examined Patent Publication Showa 38 (1963)-13925, and Japanese non-Examined Patent Publication Showa 62 (1987)-62936. In the cleaning apparatus disclosed in the first mentioned prior art, a suction duct is disposed on a spinning frame, from one end to the other end thereof along the lengthwise direction of the spinning frame, a suction blower is connected to an end of the suction duct, and an air filter is disposed at the other end of the suction duct and has a construction such that the collected fibers are separated from the suction air stream. In the cleaning apparatus of the second mentioned prior art, a plurality of fans are arranged with a predetermined intervening space between two adjacent fans on a bottom wall of an air duct disposed on a spinning frame, from one end to the other end thereof along the lengthwise direction thereof, the air duct is provided with a plurality of suction nozzles, each provided with a suction mouth opening in the wall of the air duct in a condition such that each opening of the suction nozzle faces a corresponding draft part and the draft zone of the frame. Accordingly, in this apparatus, the fibers deposited around the draft part etc. are collected by the suction action of the fans on a filter located above the above-mentioned fans, whereupon those fibers deposited on the filters are separated from the filter by an upward air flow created by rotating the respective fans in a direction reverse to the normal direction of rotation for creating a suction force. Such fibers deposited around the draft parts etc are hereinafter referred to as "fly". The above-mentioned reverse rotation of the fans is operated in order from the fan arranged at a position farthest from a suction box, which is connected to the end of the air duct, toward the suction box, and the flys separated from the corresponding fans are carried to the suction box by an air stream flowing toward the suction box.

In the third mentioned prior art, a suction fan such as a cross flow fan, which acts over the entire longitudinal length of the spinning frame, is utilized, a plurality of suction nozzles opening toward the respective draft parts and spindle parts are connected to a duct connected to the suction fan, and an endless displacable filter is arranged between the suction fan and the suction nozzles so that the flys deposited on the respective filters are removed therefrom at both ends of the spinning frame by moving the filter therearound. The apparatus of above-mentioned three prior art publications, however still requires improvement. Namely, in the first mentioned prior art, the suction effect is gradually reduced in the suction duct from a point close to the suction blower to a point far from the suction blower. On the other hand, in the second mentioned prior art, since the fans are alternately driven in a normal and a reverse direction as compared with the fan arranged at a position farthest from the suction box, wherein a suction fan is disposed to create a suction air stream in the air duct, to the fan arranged at a position closest to the suction box, the construction of apparatus becomes complicated and a complicated control process becomes necessary for the operation of the apparatus.

In the third mentioned prior art, an endless circulation filter is disposed at a position below the roller parts of a spinning machine along the lengthwise direction thereof, such that the circulation filter surrounds a portion between both end frames of the spinning machine where suction nozzles are respectively arranged, whereby the circulation filter is cleaned at both ends of the machine frame. Accordingly, the cleaning ability of the filter immediately after cleaning the surface thereof, is very different from the cleaning ability of the filter immediately before cleaning, the surface thereof. Accordingly, the suction effect of the apparatus along the longitudinal direction of the spinning frame can not be uniformally maintained, an exchange of the circulating filter is troublesome, and the apparatus has a complicated construction.

Therefore, an object of the present invention is to provide a cleaning apparatus having a mechanism such that a uniform suction effect can be created over all of the draft parts along the longitudinal direction of the spinning frame, and the handling of the collected flys and the exchange of the filters are simplified.

SUMMARY OF THE INVENTION

In the cleaning apparatus of the present invention, a carrying main duct is disposed on a machine frame along the longitudinal direction thereof at a position below the arrangement of processing roller parts such as draft parts, a filter box is connected to the one end terminal of the carrying main duct, a suction air producing unit provided with a suction fan is disposed between each of the processing roller parts and the carrying main duct, and each suction nozzle facing the corresponding processing roller part is connected to a corresponding suction fan having an outlet thereof connected to a discharge duct which is connected to the carrying duct in a manner such that it intersects same at an acute angle with respect to the filter box. The above-mentioned suction air producing unit is hereinafter simply referred to as the cleaning unit.

Accordingly, the flys sucked from the corresponding processing roller parts via the suction nozzle by the action by the suction fan of the corresponding cleaning unit are transported into the carrying duct by the suction created by the discharge air flow therefrom, and therefore, all fibers discharged from the respective suction fans of the suction air creating units are carried to the filter box by the combined discharged air flows which are discharged from all of the suction air creating units in stable condition.

DESCRIPTION OF THE PREFERRED EMBODIMENTS

The construction and function of the preferred, embodiments of the present invention are hereinafter explained in detail.

Figure 1:
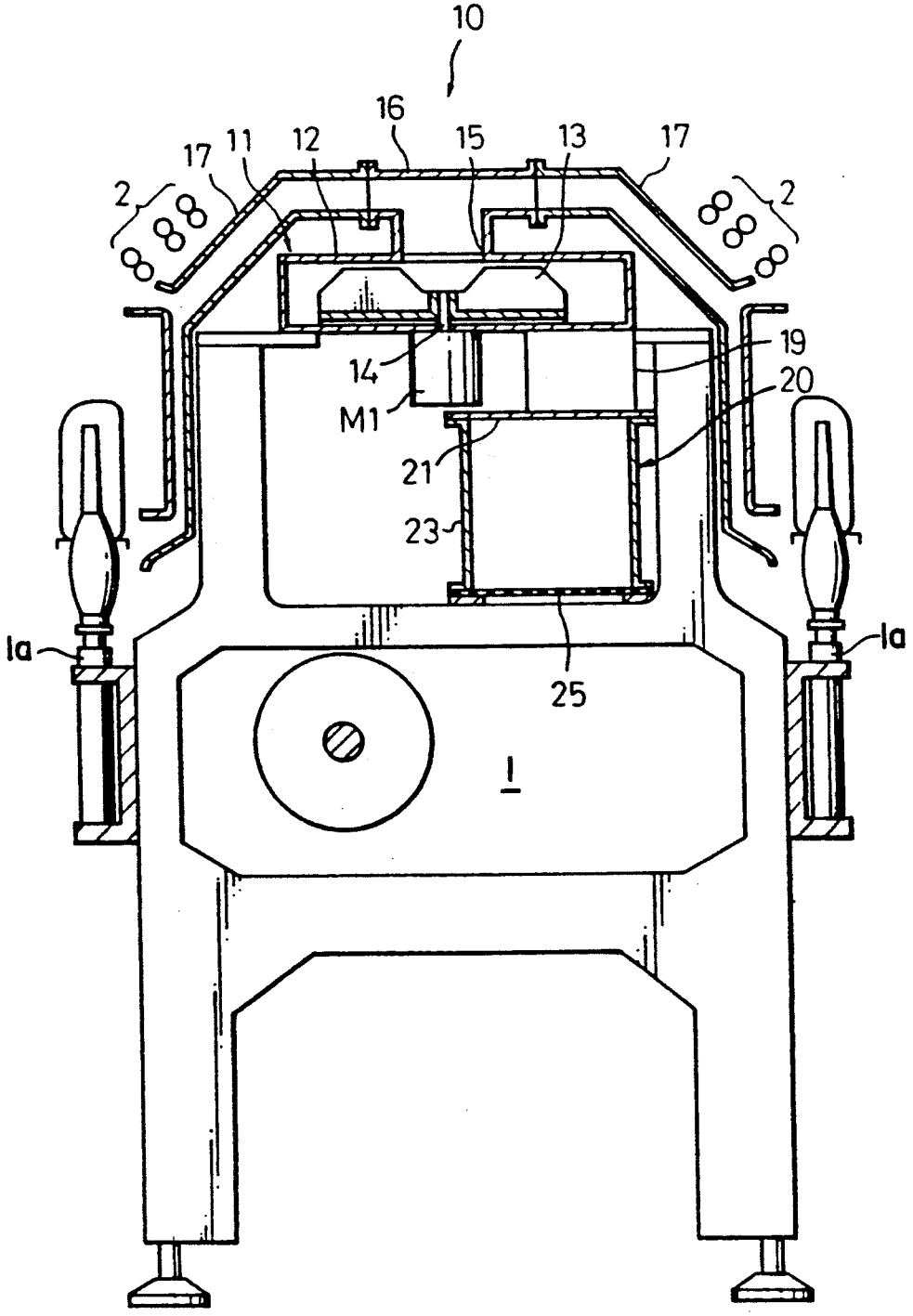
FIG. 1 is a schematic sectional view of the main part of a ring spinning frame provided with an embodiment of the cleaning apparatus according to the present invention.
Figure 2:
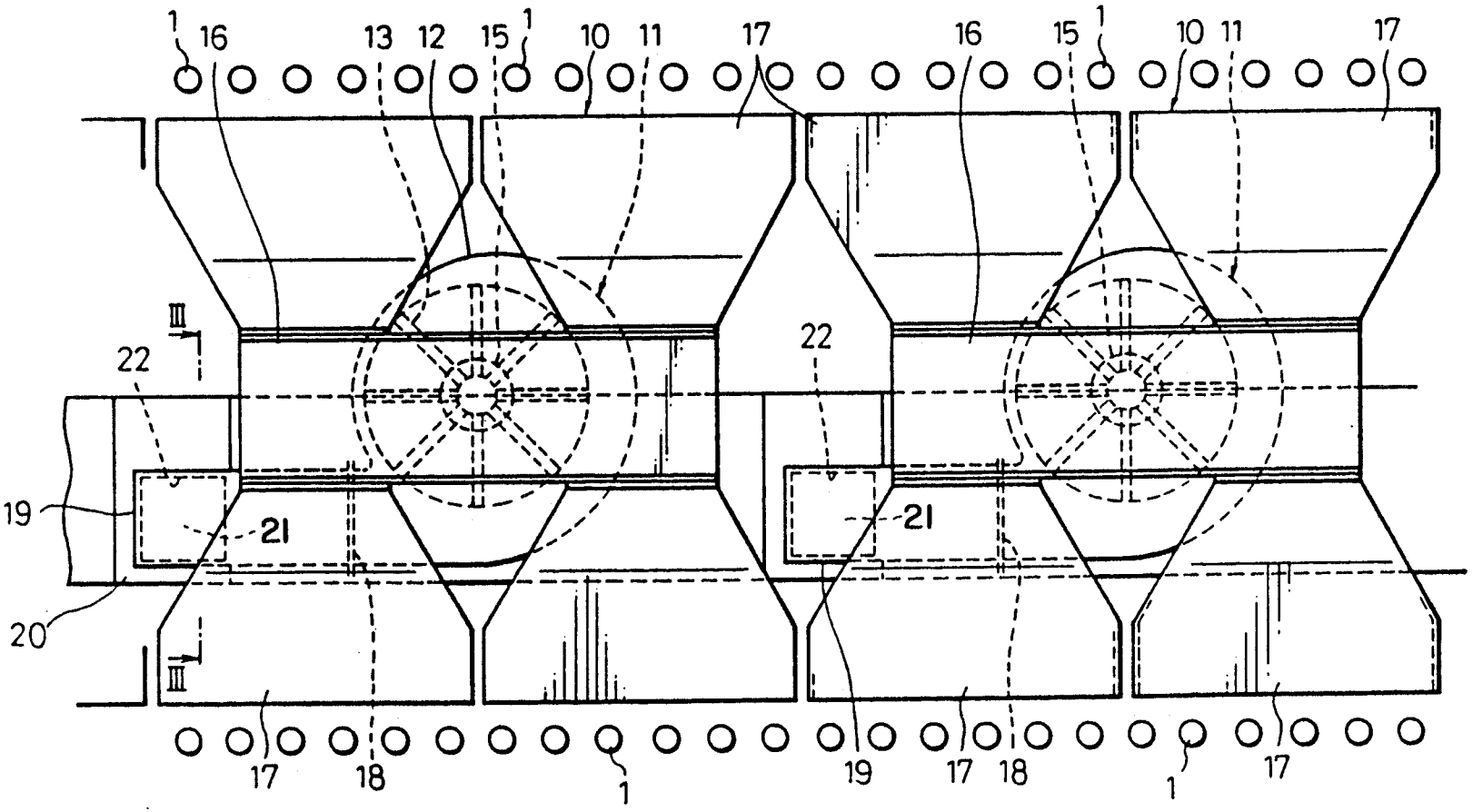
FIG. 2 is a schematic plan view of the first embodiment.
Figure 3:
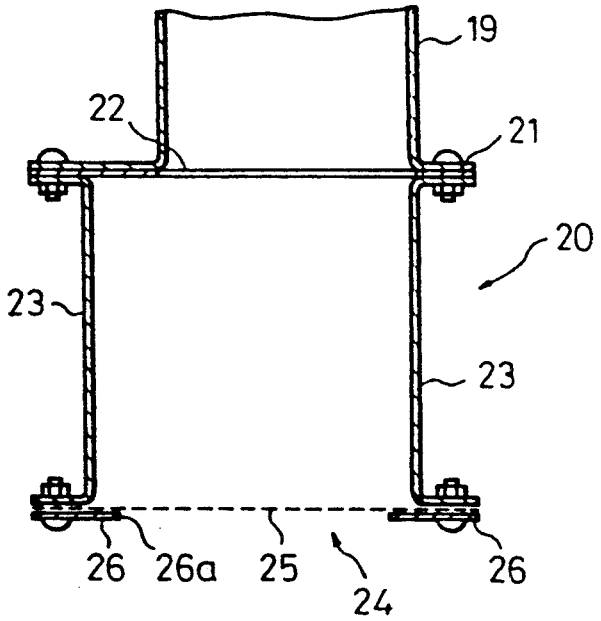
FIG. 3 is an enlarged sectional view of a part of the first embodiment shown in FIG. 1, taken along the line III—III in FIG. 2.
Figure 7:
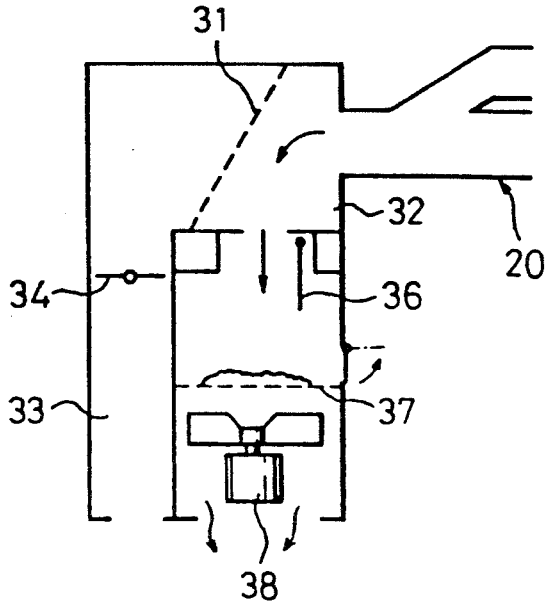
FIGS. 6 and 7 are explanatory drawings for explaining the function of the cleaning apparatus shown in FIG. 1.

A first embodiment of the present invention is explained with reference to FIG. 1 to FIG. 7 attached hereto. In FIGS. 1 and 2, a plurality of cleaning units 10 are disposed on a machine frame of a ring spinning frame 1 provided with a plurality of spindles 1*a* at both sides thereof, in an alignment along the longitudinal direction of the spinning frame 1, at a position below draft parts arranged in two alignments at respective positions above the corresponding alignment of spindle 1*a*. Each cleaning unit 10 is provided with a suction blower 11. The suction blower 11 is a plate type fan and is provided with a plurality of fan blades 13 radially secured to a fan shaft 14, which also functions as a shaft of a drive motor M, and the fan blades 13 are rotated around the axial center of the motor shaft 14 in a casing 12. The above-mentioned motors M of the cleaning units 10 are hereinafter identified as M1, M2, M3 . . . Mn. Each casing 12 is provided with an aperture 15 arranged coaxially to the motor shaft 14, and a box type connection duct 16 is connected to the aperture 15. The connection duct 16 is connected to two pairs of suction nozzles 17, one of which pairs are successively disposed at a position below corresponding unit alignments of the draft parts at one side of the spinning frame, and the other pair of the suction nozzles 17 disposed at a position below corresponding unit alignments of the draft parts at the other side of the spinning frame. The number of draft parts which are subjected to the cleaning action by each suction nozzle 17 is identical; in this embodiment, the above-mentioned number is six. Accordingly, each cleaning unit 10 acts on 24 spindles of the spinning frame.

As shown in FIG. 1, each suction nozzle 17 is provided with an aperture opened at a position in the proximity of a bottom front roller of the draft parts 2, and each suction nozzle 17 is extended to a position in the proximity of the inside of the arrangement of the spindles and another aperture is formed at the terminal of this extension and facing the arrangement of spindles. However, the above-mentioned extension of the suction nozzle 17 can be omitted. The casing 12 is provided with a spiral duct having a discharge outlet 18 is connected to a discharge duct 19 so that the flow direction of air introduced to the suction blower 11 via the aperture 15, in the axial direction of the blower 11, is turned to a direction at a right angle to the axial direction of the blower 11, so that the introduced air is discharged to the discharge duct 19. A main duct 20 is disposed on the machine frame of the spinning frame 1 along the longitudinal direction of the spinning frame 1, from one end to the other. A plurality of apertures 22 for introducing an air stream into the discharge duct 19 are formed on an upper cover plate 21 of the discharge duct 19, at an identical pitch and in an alignment along the longitudinal direction thereof, and the cleaning units 10 are connected to the respective apertures 22 by the corresponding discharge duct 19 such that each discharge duct 19 is connected to the main duct 20 at an acute angle, for example, 30 degrees, with respect to the lengthwise direction of the main duct. Accordingly, the air stream discharged from each cleaning unit 10 is smoothly introduced into the main duct 20 in such a manner that the air streams discharged from each cleaning unit 10 are joined together and smoothly carried to a discharge outlet of the main duct 20.

A filter box 30 is connected to the main duct 20 at the discharge outlet thereof. The motors M of cleaning units 10 are hereinafter identified as M1, M2, M3, . . . Mn according to the arrangement thereof, in the order from the position farthest from the filter box 30 so that the cleaning unit 10 provided with the motor M1 is simply referred to as the unit 10 of the motor M1, the cleaning unit 10 provided with the motor M2 is simply referred to as the unit 10 of the motor M2, . . . and so on.

The velocity of the above-mentioned discharge air stream from the unit 10 of the motor M1 passing through the duct 20 is at a constant velocity (vo) before the point at which this air stream is combined with the discharge air stream from the unit 10 of the motor M2, and thereafter, the velocity of the discharge air stream is raised. Accordingly, the air stream discharged from the corresponding units 10 can be partly discharged through the bottom aperture 24 so that the velocity of the discharged air stream in the duct 20 can be maintained in a desirable condition. The main duct 20 is provided with a bottom aperture 24 formed in the bottom surface thereof, in a range of from a position close to the filter box 30 to a position close to and upstream of the position at which the discharge duct 19 of the cleaning unit 10 is connected to the main duct 20, and the aperture 24 is covered by a filter net 25.

As explained above, the main duct 20 is provided with a closed bottom portion extended toward the upstream terminal thereof from a position from the above-mentioned intermediate position below and between the motor M1 and the motor M2, the discharge air stream from the unit 10 of the motor M1 passes through the duct 20 with an initial speed Vo and this air stream is combined with the air stream discharged from the unit 10 of the motor M2, and since air having a volume almost identical to the volume of air stream discharged from the cleaning unit 10 of the motor M2 is discharged through the bottom aperture 24 of the main duct 20 between the cleaning unit 10 of the motor M2 and the cleaning unit 10 of the motor M3, the velocity of the air stream in the main duct 24 substantially returns to the velocity Vo at the position where the air stream discharged from the cleaning unit 10 of the motor M3 is combined with the air stream from the upstream position in the main duct 20. Such a variation of the velocity of the air stream is repeatedly created downstream of the main duct 20 with respect to each cleaning unit 10. The filter box 30 is provided with a filter 31 disposed at a position in the proximity of the entrance thereof, and a discharge passage 33 provided with a damper 34 disposed turnably around a supporting axis disposed therein, and another suction fan 38 disposed at a position in another discharge duct 35 and provided with a discharge damper 36 disposed just below the filter 31 and a filter 37 arranged at a position between the discharge damper 36 and the suction fan 38. Therefore, when the flys collected by the cleaning units 10 are introduced into the filter box 30, since the discharge passage 33 is not closed by the damper 34, the discharged air stream passing through the filter 31 is discharged only to the outside thereof via the passage 33. According to the above-mentioned function of the filter box 30 wherein the discharge air from the main duct 20 escapes from the discharge passage 30 after passing through the filter 31, and flys are deposited on the filter 31. When the discharge damper 36 is opened while driving the suction fan 38, the air discharge from the main duct 20 is positively directed into the discharge room 35, while a certain volume of air from the discharge passage 30 is introduced into the discharge duct 35 via the filter 31, and thus the block of flys deposited on the filter 31 is taken from the filter 31 and dropped into the discharge duct 35.

Figure 4:
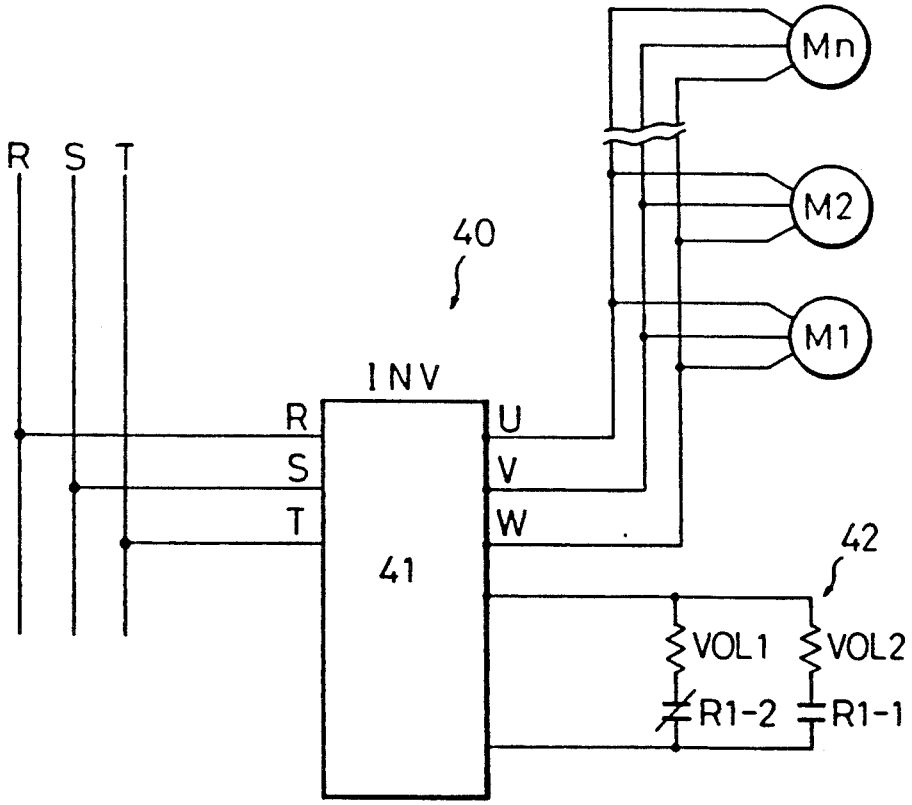
FIG. 4 shows a drawing circuit applied to the first embodiment of the present invention.
Figure 5:
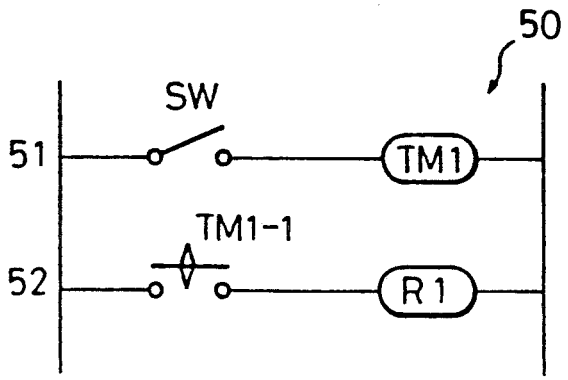
FIG. 5 shows a control circuit of a motor utilized for the cleaning apparatus shown in FIG. 1.
Figure 6:
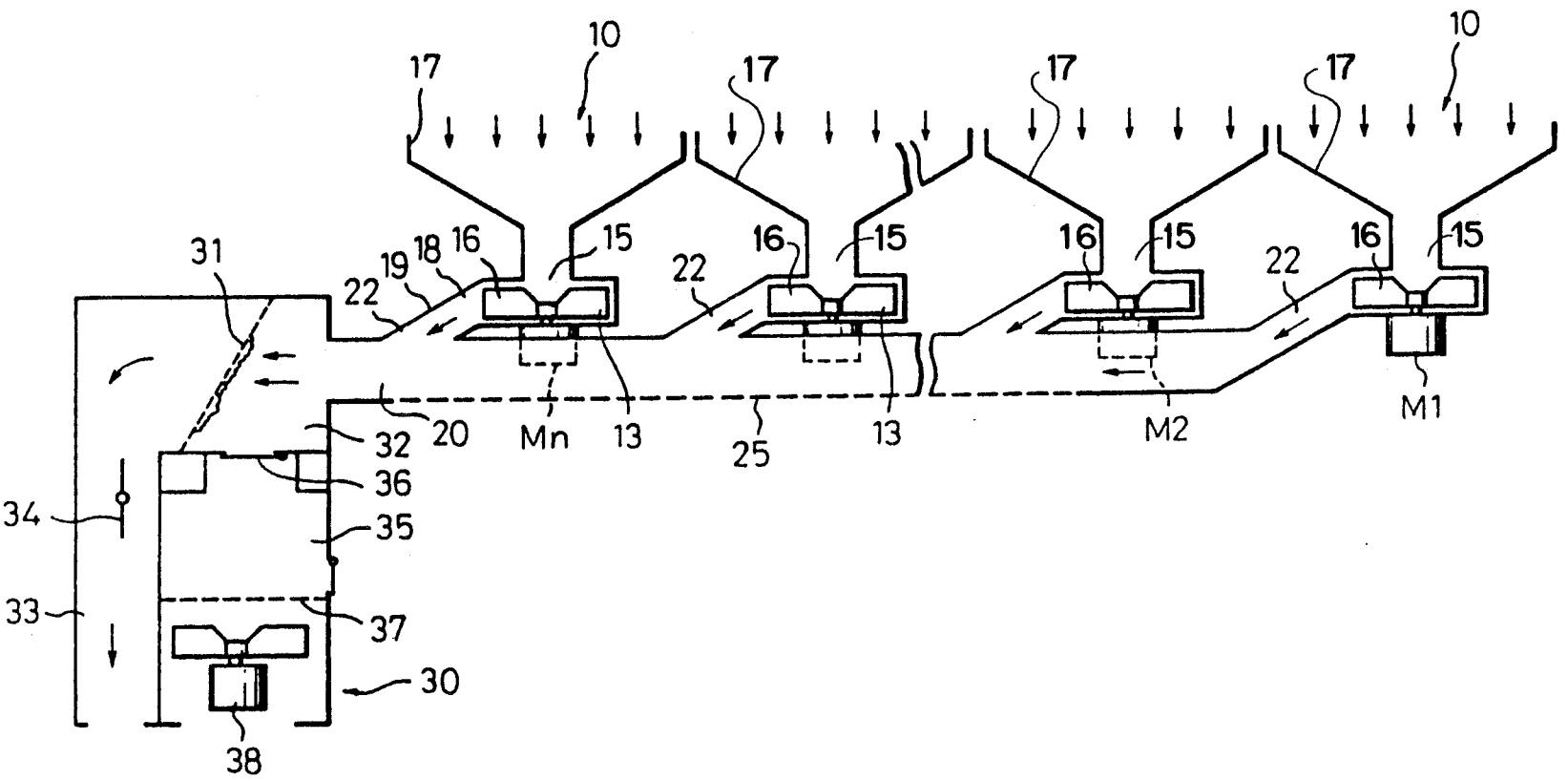

An electric circuit for actuating each cleaning unit 10 is composed of a circuit 40 shown in FIG. 4, for driving the motors M, and a circuit 50 shown in FIG. 5, for controlling the driving of the motor M. The control circuit 50 is actuated by a starting switch SW for driving the spinning frame and is provided with a time setting circuit 51 which comprises a timer TM1 for counting time and a drive speed change circuit 52 composed of a relay R1 by which the rotation speed of the motors M is changed. The circuit 52 is connected in series to a contact TM1-1 of the timer TM1. The timer TM1 opens or closes a connection at predetermined times. Namely, the contact TM1-1 is closed for a predetermined time (t) after a predetermined time T has passed, and thereafter, the contact TM-1 is opened so that the timer TM1 is reset. In this embodiment, the above-mentioned predetermined time T is determined as a time needed for driving the motors M of the respective cleaning units 10 under normal conditions, and the above-mentioned predetermined time t is determined as a time at which the motor M is driven at a high speed. For example, the times T and t can be determined as one hour and one or two minutes, respectively.

In the circuit 40 provided with a usual inverter 41 (for general use), output terminals u, v, and w are connected in parallel to the respective motors M1, M2, . . . Mn of the respective cleaning units 10. A volume VOL 1, which determines the rotation speed of the motors M in the above-mentioned normal driving condition, and another volume VOL 2 which determines the rotation speed of the motors M in the above-mentioned high speed condition, are connected to the inverter 41 via contacts R1-1, R1-2, i.e., an "a" contact and a "b" contact of the relay R1, respectively, whereby a frequency setting device 42 is constructed.

The function of the cleaning apparatus mentioned above, is hereinafter explained in detail.

Upon starting the driving of the main motor of the spinning frame, the time TM1 of the circuit 51 starts to count. In this condition, since the relay R1-1 is open, the relay R1 is not magnetized, whereby the contact R1-2, which is the "b" contact of the circuit 40, is kept closed and a frequency is set by the volume VOL 1 by which the motor M of each cleaning unit 10 is driven in a normal speed condition. In this condition, the flys deposited at around each of the roller parts 2 and spindles 1 are sucked into the respective nozzles 17 by the suction air stream created by the rotation of the fan blades 13 of each blower 11. These flys introduced into the suction nozzles 17 are carried into the respective casing 12 of each blower 11, via the inlet aperture 15 thereof, after being passed through the respective ducts 16 by the action of the suction air stream. Thereafter, the flys are discharged into the main duct 20 from the discharging outlet 18, by the discharging air stream. Accordingly, the flys discharged from the respective blowers 11 by the discharging air stream can be carried into the filter box 30 by the combined air stream flowing toward the filter box 30. Since the volume of the discharged air stream in the main duct 20 directed to the discharge terminal thereof can be maintained at a desirable value, which is almost identical to the volume of the air stream discharged from each one of the cleaning units 10, as mentioned above, the creation of noise can be prevented and the rise of the resistance by the inside wall of the main duct 20 against the air stream in the duct 20, which is dependent upon a possible increase of the volume of the air stream in the main duct 20, can be effectively prevented, and accordingly, the back pressure at each cleaning unit 10 can be always maintained in an almost uniform condition, and thus an almost uniform suction capacity can be maintained at each cleaning unit 10. The flys carried into the filter box 30 by the above-mentioned air stream are separated therefrom when this air stream passes through the filter 31, and the air stream is discharged from the filter box 30 via the discharging passage 33 in which the damper 34 is kept open. The above-mentioned flys separated from the air stream are deposited on the filter 31 during the above-mentioned discharge of the air stream, and the deposited flys are separated from the filter 31 by closing the passage 33 by the damper 34, for a predetermined time, while opening the damper 36 and driving the suction fan 38. Accordingly, the flys are separated from the filter 31 and deposited on the screen 37 in the room 35, and are removed from the screen 37 at predetermined intervals.

The major part of the air stream discharged from the cleaning units 10 is discharged from the aperture 24 via the filter net 25, and thus the flys contained in the above-mentioned air stream are pressed against the filter net 25 and deposited thereon and thus a resistance to the flow of the air stream through the net 25 covering each aperture 24, is increased. In such a case, the flow resistance in the main duct 20 is raised, and accordingly, the required uniform suction capacity of each cleaning unit 10 can not be maintained. In this embodiment, this is prevented by cleaning the net 25 at predetermined intervals. Namely, when a predetermined time T has passed after starting the drive of the main motor of the spinning frame, i.e., after the motors M are driven at the normal drive speed for the time T, the timer TM1 is incremented and the timer contact TM1-1 is closed, whereby the relay R1 is magnetized. Accordingly, the relay contact R1-2 of the circuit 40 is opened and the relay contact R1-1 is closed, whereby the frequency generated by the frequency setting device 42 is changed so that the drive speed of the motor M of each cleaning unit 10 is increased to a predetermined high speed, for example, 1.5 times the normal drive speed thereof. Therefore, the flow speed of the air stream in the main duct 10 towards the filter box 30 is raised, and accordingly, flys firmly deposited on the net 25 covering the corresponding aperture 24 are forcibly separated therefrom and carried to the filter box 30 by the higher speed air flow. The above-mentioned condition is maintained for a predetermined time t, and when the time t is passed, the timer contact TM1-1 is opened and the timer TM1 is automatically reset, whereby rotation speed of the motor M of each cleaning unit 10 is returned to the normal rotation speed.

Figure 8:
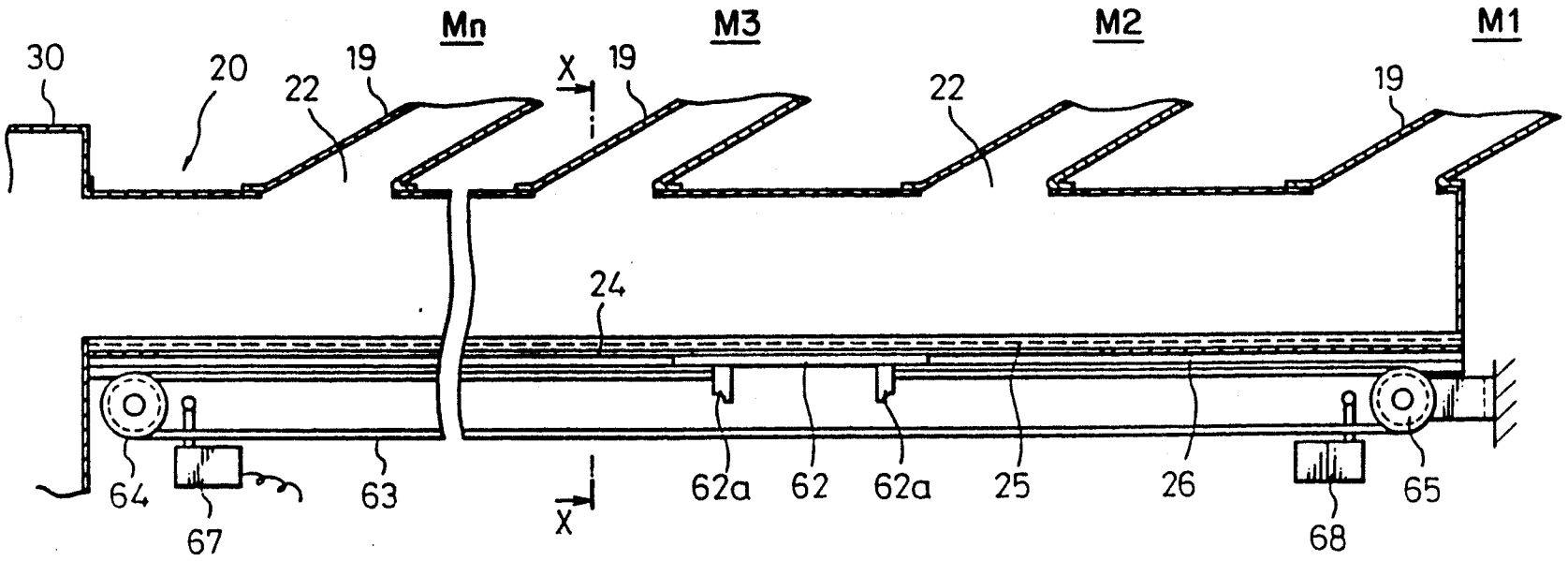
FIG. 8 is a schematic longitudinal cross sectional view of the second embodiment of the present invention.
Figure 9:
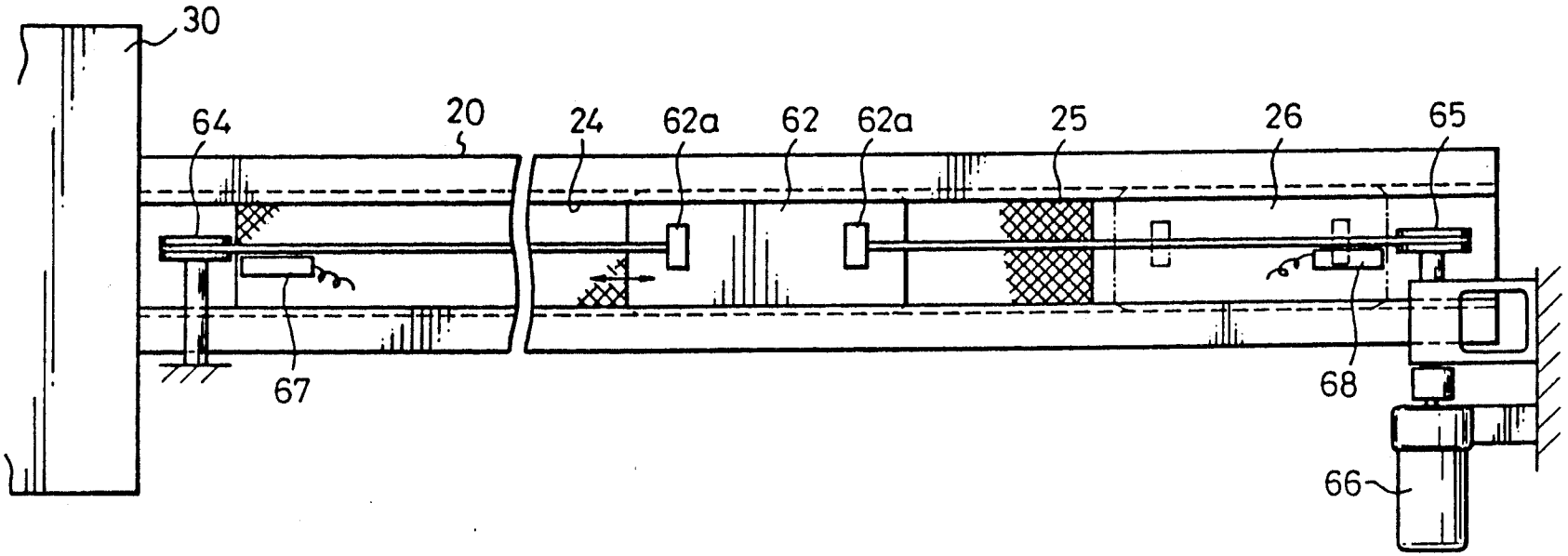
FIG. 9 is a plan view from the bottom surface of the apparatus shown in FIG. 8.
Figure 10:
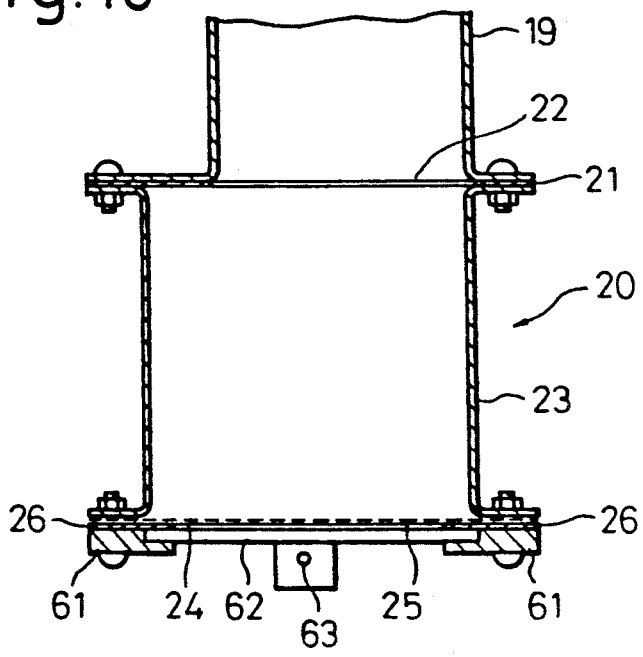
FIG. 10 is an enlarged sectional view of the embodiment shown in FIG. 8, taken along a line X—X in FIG. 8.

In place of the above-mentioned apparatus for cleaning the net 25, to maintain the condition of the uniform cleaning function of each cleaning unit 10, the following modification can be applied. Namely, as shown in FIG. 8, the main duct 29 is provided with a frame bottom plate 26 wherein the rectangular aperture 24 is formed along the lengthwise direction thereof. The aperture 24 extends for almost the entire length of the framed bottom plate 26 except for the position upstream from the position at which the discharge duct 19 of the cleaning unit 10 of the motor M2 is connected to the main duct 20. A pair of guides 61 having a respectively length identical to the framed bottom plate 26 are formed on the main duct 20 and the aperture 24 is entirely covered with the net 25, and a closing plate 67 is displaceably supported by the guide 61. The above-mentioned bottom aperture 24 is covered with a net 25. A pair of guides 61 are fixed to longitudinal edge bottom portions of the main duct 20, and closing plate 62 is displaceably supported by the above-mentioned guides 61. The closing plate 62 is provided with a pair of engagement projections **62*a*, 62*b* rigidly mounted on the bottom surface thereof, and a pair of guide pulleys 64 and 65 are rotatably mounted on both longitudinal end portions of the spinning frame 1. A long belt 63 is mounted on the pulleys 64, 65 in such a manner that the engagement projections 62*a*, 62*b* of the closing plate 62 are connected to the corresponding one end of the belts 63 so that the closing plate 62 can be displaced along the guides 61 by rotating these guide pulleys 64, 65. To drive the belt 53, the pulley 65 is coaxially and rigidly mounted on a motor shaft of a drive motor 66 mounted on the spinning frame 1. A pair of limit switches 67 and 68 are arranged at respective positions in proximity to the guide pulleys 67 and 68 such that, when the limit switch 67 or 68 is actuated by engagement with a projection 62*a* fixed to the closing plate 62, the rotational direction drive motor 66 is alternately changed. Accordingly, in this modified embodiment, when the drive motor 66 is driven in the normal direction, whereby the closing plate 62 is displaced from one longitudinal end to the other longitudinal end of the main duct 20, and when closing the net 25, and the limit switch 67 is engaged with the projection 62*a*, the rotation direction of the motor 66 is changed so that the displacement direction of the closing plate 62** is changed to the side opposite to the previous displacement direction.

In this embodiment, the motor 66 is driven in the normal direction so that the closing plate 62 is displaced toward the filter box 30 from the upstream end portion of the net 25, while partly closing off the net 25, and when the limit switch 67 is actuated by the projection **62*a*, the drive direction of the motor 66 is reversed so that the closing plate 62 is displaced in the direction opposite to the above-mentioned displacement toward the filter box 30. According to the above-mentioned reciprocal displacement of the closing plate 62, the net 25 is partly closed by the closing plate 62 such a partly closed portion of the net 25 is also moved toward the filter box 30 in accordance with the displacement of the closing plate 62, and then the displacement direction is reversed to the above-mentioned direction. Accordingly, a discharge of air through the net 25 is stopped by the above-mentioned closing action by the closing plate 62. Namely, the above-mentioned closed portion of the net 25 is moved towards the filter box 30 and then moved in the direction away from the filter box 30, according to the above-mentioned reciprocal displacement of the closing plate 62. When a portion of the net 25 is not closed by the closing plate 62, a part of the flys carried by the discharging air stream from the cleaning unit 10 can be deposited on this portion, because this portion allows a free passing of the discharged air. When this portion of the net 25 is closed by the closing plate 25, however, the deposited flys can be easily separated from this portion of the net 25 and carried towards the filter box 30 by the discharged air stream flowing toward the filter box 30 in the main duct 20. Accordingly, the flys deposited on the net 25 are separated from the net 25 by the reciprocal displacement of the closing plate 62 and carried to the filter box 30**.

Figure 11:
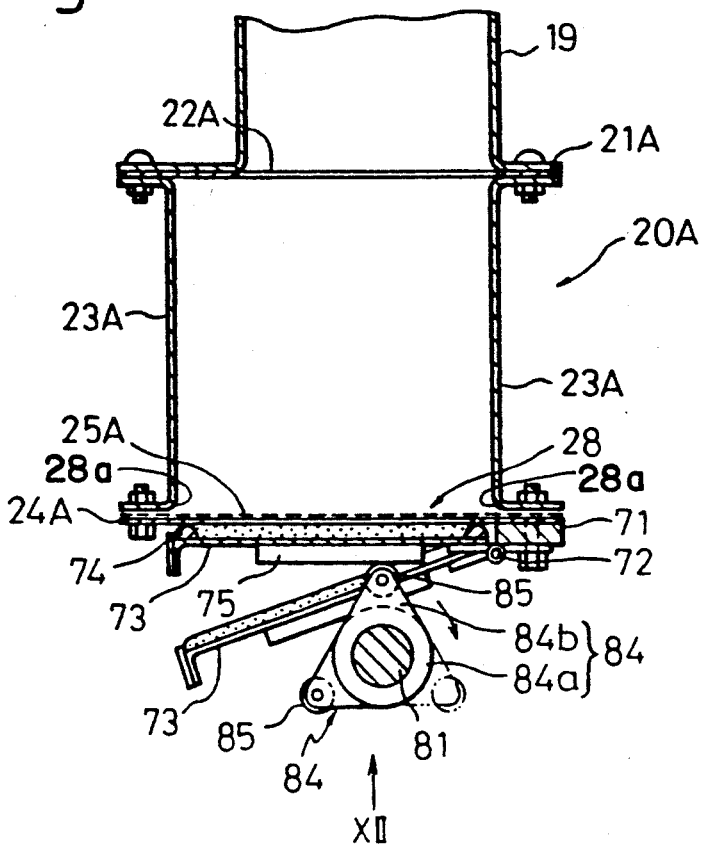
FIG. 11 is a schematic cross sectional view of the carrying duct applied to the third embodiment of the present invention.

The third embodiment of the apparatus according to the present invention is hereinafter explained in detail with reference to FIGS. 11 to 15. As shown in FIG. 11, the main duct 20A has a rectangular cross section formed by an upper plate 21A, a pair of side plates 23A, and a bottom plate 24A, in such a manner that filter net 25A having an identical size and shape as the bottom plate 24A, i.e., the dimensions of the width and length thereof are identical to those of the bottom plate 24A, is intervened between the bottom edge portion of the side plates 23A and the bottom plate 24A. The bottom plate 24A is provided with a plurality of apertures 28, except for a portion 24Ab upstream of a position facing the unit of the motor M2, such that each aperture 28 is formed at a position between two adjacent spring pieces 3. In this construction, the both sides of each spring piece 3 and the edge of the aperture 28 with respect to the lengthwise direction of the bottom plate 24A is solid. As shown in FIG. 11, the inside edges **28*a* of the aperture 28, which face each other in the transverse direction of the bottom plate 24A, are positioned just inside both bottom edges of the side plates 23A when the main duct 20A is constructed. The mesh of the net 25A and the area thereof are designed to satisfy a condition such that the volume of air discharged through the aperture 28 and the net 25A is equal to the volume of the air stream discharged from each cleaning unit 10 per unit of time, and thus the flow speed of the air stream discharged toward the filter box 30** can be maintained within a predetermined range of, e.g., 6 to 20 m/s.

Figure 12:
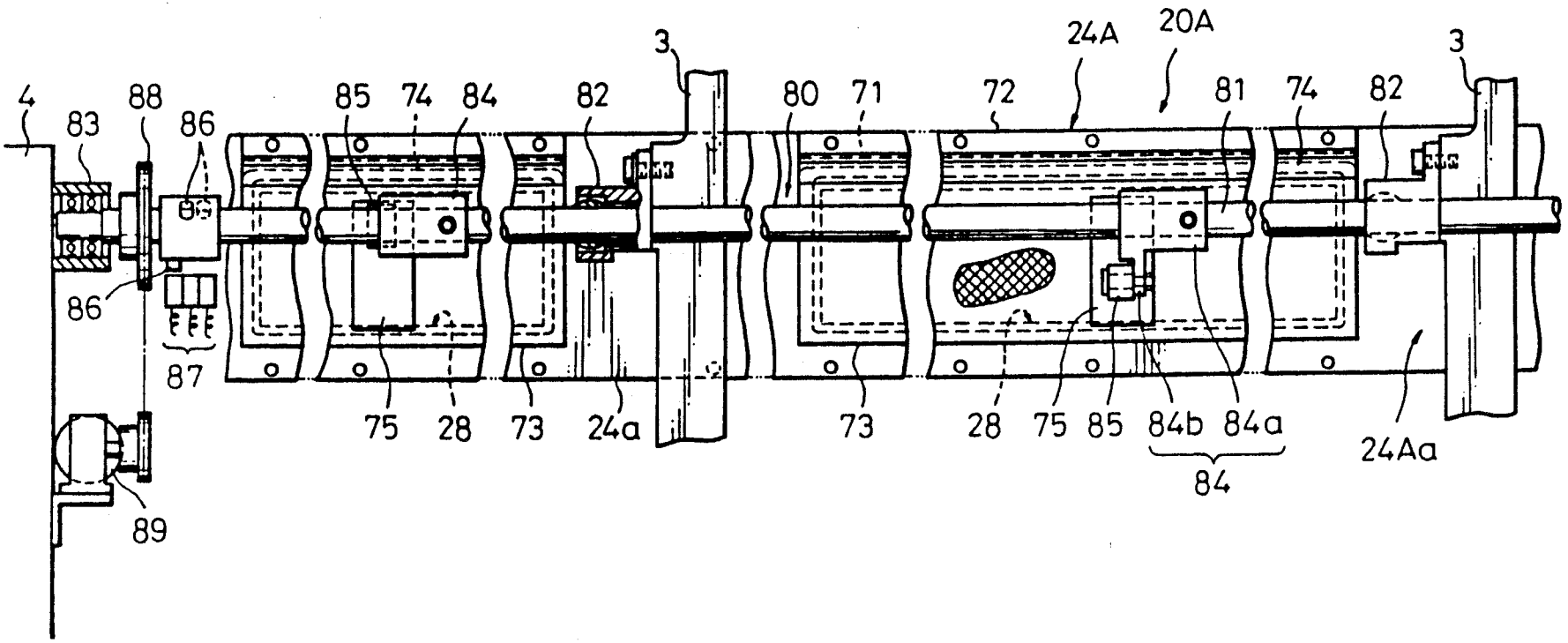
FIG. 12 is a view of the carrying duct, from a direction indicated by an arrow XII in FIG. 11.
Figure 13:
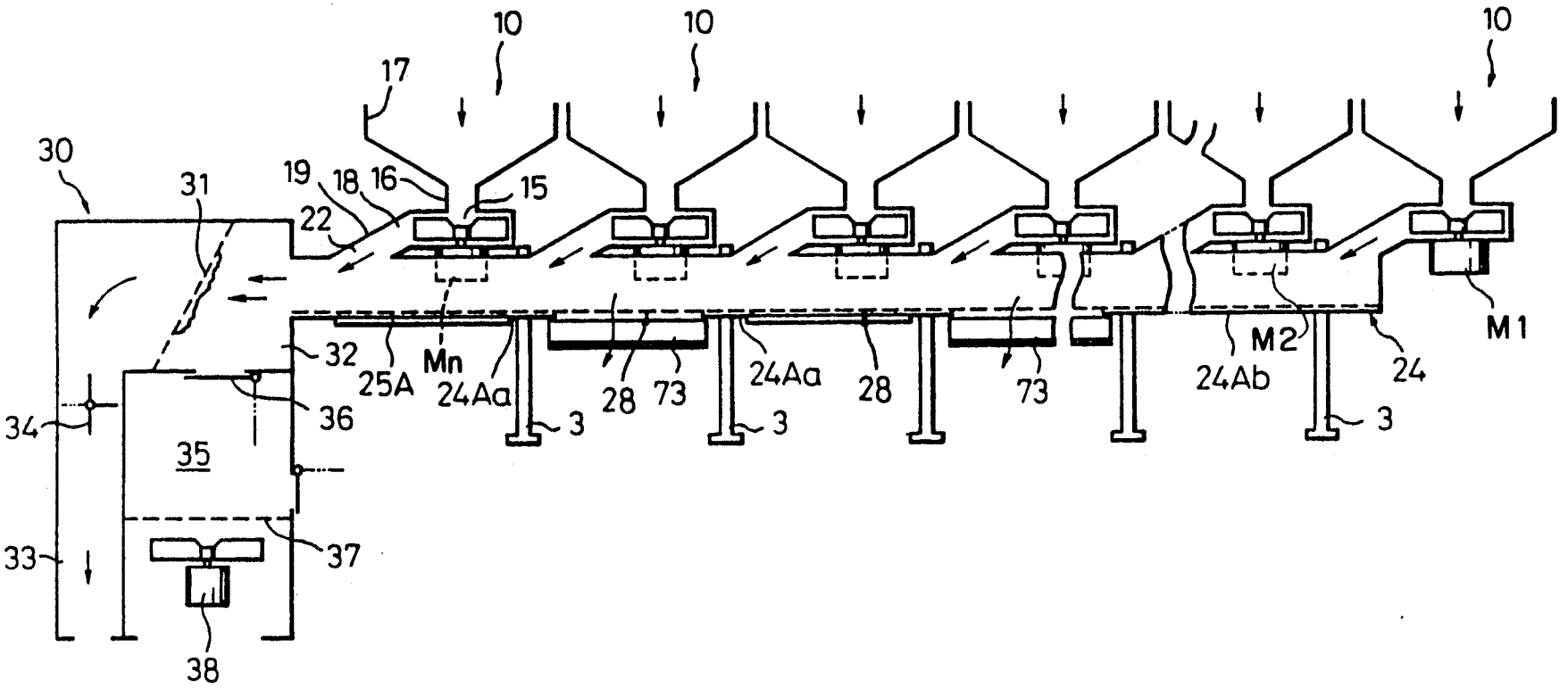
FIG. 13 is an explanatory drawing of the third embodiment showing the condition wherein the air-shutters thereof are alternately closed along the longitudinal direction of the carrying duct.
Figure 14:
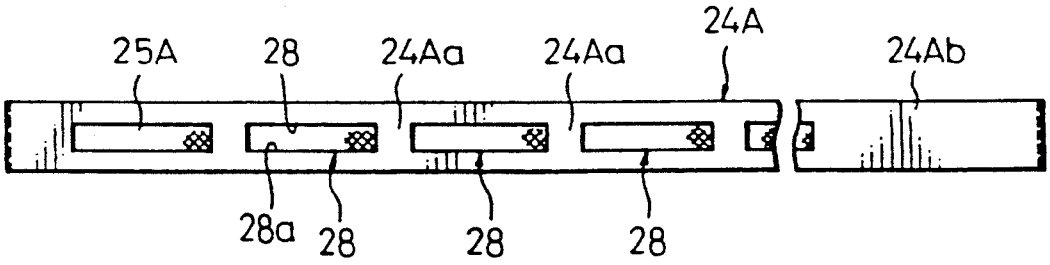
FIG. 14 is an explanatory drawing of the third embodiment showing the open position of the filter opening part.

As disclosed in FIG. 11, a hinge 72 is secured to the side plate 23A together with the bottom plate 24, via a spacer 71, by a bolt. The length of the hinge 72 with respect to the longitudinal direction of the main duct 20A is slightly longer than the length of the aperture 28, and the length of the spacer 71 is identical to the length of the hinge 72. An edge of an air shutter 73 is secured to the hinge 72. As shown in FIG. 12, the air shutter 73 has a rectangular shape having an area slightly larger than that of the aperture 28, and a packing 74 is fixed to the edge portion of the air shutter 73 such that, when the air shutter 73 is closed, the aperture 28 is completely sealed. Accordingly, the aperture 28 is opened or closed by turning the air shutter 73. A contact plate 75 in contact with an actuation roller 85 for turning the air shutter 73, is fixed to the bottom surface of the air shutter 73.

Next an actuation device 80 for actuating the air shutter 73 is explained with reference to FIG. 12.

A shaft 81 extending along the entire length of the main duct 20A is rotatably supported by a-ball bearing 82 arranged at the spring pieces 83 and a bearing 83 arranged of an outer-end frame 4 of the spinning frame, below the main duct 20A, As shown in FIG. 11, a cam lever 84 is secured to the shaft 81 at respective positions facing the contacting plate 75 of the corresponding air shutter 73. The cam lever 84 comprises a cylindrical base portion 84 and a projecting portion **84*b* provided with a roller 85 rotatably mounted thereto, and when the roller 85 pushes against the contact plate 75, the air shutter 73 closes the aperture 28, and when the shaft 81 is further rotated, the contact plate 75 is turned to open the aperture 28 until the roller 85 again pushes against the contact plate 75. The above-mentioned cam levers 84 are secured to the shaft 81 in such a manner that at the angular phase-difference between two adjacent cam levers 84 in a group of three levers 84 along the lengthwise direction of the shaft 81 is always 120 degrees, whereby the following three conditions of the air shutter 73 can be created. That is, in each group of three levers 84, At the end portion successively arranged along the lengthwise direction of the shaft 81, when the roller 85 of one of these three cam levers 84 pushes against the corresponding contact plate 75, so that the corresponding shutter 73 is closed, the rollers 85 of the other two cam levers 84 taken an angular position with regard to the shaft 81 in the respective condition such that they support the corresponding shutters 73 at the opened position thereof. Accordingly, each group of these shutters 73 successively arranged along the lengthwise direction of the shaft 81 is alternately closed each time the shaft 81 turns through 120 degrees. The shutter 73 in the opened condition is hereafter referred to as the air shutter 73 of a group A, and the shutter 73 in the closed condition is hereinafter referred to as the air shutter of group B. At the end portion of the shaft 81, which corresponds to the outer end of the spinning frame, three dogs 86 are mounted on the shaft 81 with a 120 degrees angular phase difference between two adjacent dogs 86, to detect the respective angular positions of the rollers 85 corresponding to the above-mentioned three conditions. These three dogs 86 are mounted on the shaft 81 with a space between two adjacent dogs 86 with respect to the axial direction thereof. To detect the above-mentioned conditions by the dogs 86, three detecting switches 87 are arranged in an alignment along the axial direction of the shaft 81, and a sprocket wheel 88 is secured to the shaft 81 by a key and is driven by a worm reducing motor 89, provided with a brake and mounted on the end frame 4** of the spinning frame, via a chain drive.

Figure 15:
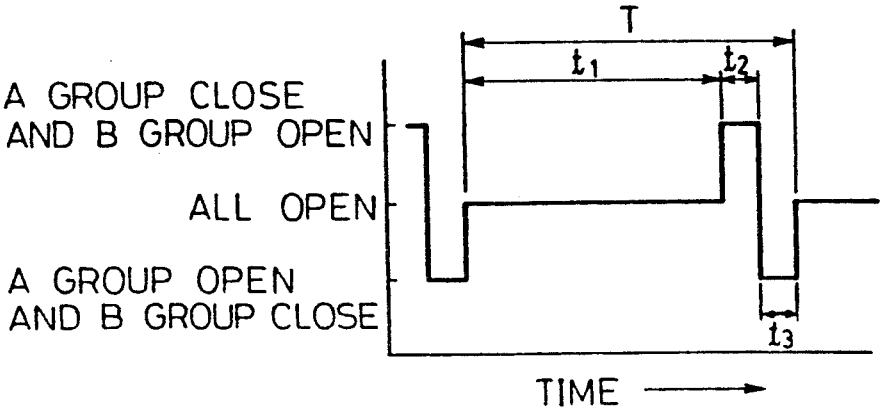
FIG. 15 is an explanatory drawing showing a timing chart of the opening and closing operations of the air shutter utilized for the third embodiment.

The ON-OFF actuation of the worm wheel speed reduction motor 89 is controlled by an actuation mechanism which comprises three timers (not shown) and three detecting switches 87 in a manner such that the above-mentioned three conditions of the air shutter 73 are maintained for a first time of t-1 for opening all of the air shutters 73, a second time of t-2 for opening the air shutters 73 of the A group and, a third time of t-3 for opening the air shutters 73 of the B group. The relationship among the above-mentioned times t-1, t-2, t-3 is shown in FIG. 15.

Next, when starting the drive of the spinning frame, the drive by the motor M of each cleaning unit 10 is simultaneously started. In this condition, all of the air shutters 73 are kept open. When the motor M is driven, the fan blades 13 of the blower disposed of each cleaning unit 10 are rotated so that flys deposited around the corresponding roller part 2 are sucked into the suction nozzle 17 of this cleaning unit 10, the sucked flys are introduced into the casing 12, and then into the main duct 20A together with the air stream discharged via the discharging outlet 18. The flys introduced into the main duct 20A are carried to the filter box 30 by the flow of the air stream discharged toward the main box 30.

The flow speed of the air stream discharged from the unit 10 of the motor M1 and passing through the main duct 20A is a constant speed (vo) at a point at which the air stream discharged from the unit 10 of the motor M2 is combined therewith, and the flow speed of the discharged air streams is rapidly raised at the above-mentioned point at which the two discharged air streams are combined. Nevertheless, in the portion of the main duct 20A between the unit 10 of the motor M2 and the unit 10 of the motor M3, since the air discharged from these cleaning unit 10 is discharged from the aperture 28, the flow speed of the air stream in the main duct 20A is returned to (vo) at the point at which the air stream is combined with the air stream discharged from the unit 10 of the motor M3, whereby flow speed of the air stream toward the filter box 30 in the main duct 20A can be maintained below a predetermined limit, and thus the creation of noise can be prevented while maintaining a uniform collecting capacity of the flys by each suction nozzle 17. Since each air shutter 73 is kept open so that a portion of the air stream discharged from a corresponding cleaning unit 10 is discharged therefrom, flys carried by the respective discharged air streams are deposited on the portion of the filter net 25A covering the aperture 28. On the other hand, the flys are not deposited on the portions of the filter net 25A which cover the portion 24Aa of the bottom plate 24A between two adjacent apertures 28 and the portion 24Ab of the bottom plate 24A, because the above-mentioned air stream can not be discharged through these portions. Accordingly, the flys deposited on the respective portions of the net 25A above the corresponding aperture 28 are not connected to each other. When the predetermined time t-1 has expired, the motor 89 is driven, and when the one of the detecting switches 87 detects a 120 degree rotation of the shaft 81, the drive of the motor 89 is stopped. In this condition, the air shutters 73 of the A group are closed by the pushing action of the respective rollers 85 so that passage of the air flow therethrough is stopped. Accordingly, the flys deposited on the respective net portions 25A covering the corresponding apertures 28 closed by the corresponding air shutter 73 are separated from the above-mentioned filter net 25A, and since these deposited flys are not connected to each other as mentioned above, the separated flys are carried to the filter box 30 by the discharged air stream in the main duct 20A. When the predetermined time t-2 has expired, the motor 89 is again rotated for 120 degrees and the air shutters 73 of the B groups are closed, by the same motion as that of above-mentioned air shutters 73 of the A group, and accordingly, the flys deposited on the net portion 25A covering the apertures 28 closed by the above-mentioned air shutters 73 of the group B are carried to the filter box 30 in the same ways as the flys deposited on the net portion **25*a* of the air shutters 73 of the A group. When the time t-3 has expired, the shaft 81 is turned for 120 degrees so that the air shutters 73 are returned to the original positions wherein all of the air shutters 73 are open. According to experiments, it was found that preferably the times t-2, and t-3 are preset as 10 to 20 seconds, respectively, and that the time T of the total cycle of the above-mentioned three-phase motion of the air shutters 73** is preferably preset as 10 to 20 mins.

As mentioned above, the flys deposited on the filter net 25A are separated therefrom at a predetermined intervals, and thus a clogging of the net 25A by the flys is effectively prevented. Accordingly, a lowering of the discharge capacity of air stream through the filter net 25A is prevented, and accordingly, the flow speed of the air stream in the main duct 20A toward the filter box 30 is kept substantially at a constant velocity and a raising of the flow resistance due to an increase of the volume of the air flowing in the main duct 20A toward the filter box 30, due to a clogging of the filter net 25A by the deposited flys, can be kept within allowable limits. In the second and third embodiments, component elements of both embodiments having an identical function are represented by identical reference numerals respectively, to simplify the explanation thereof.

As explained with reference to the above three embodiments, since cleaning units 10, acting on a predetermined number of spinning units, are arranged in an alignment on the machine frame along the longitudinal direction of the spinning frame, variations of the suction capacity thereof at the spinning units can be greatly restricted, in comparison with the known system provided with a suction device for creating a suction for collecting flys at one end of the spinning frame, and accordingly, a highly effective cleaning of the flys deposited on the spinning units, compared with the above-mentioned known device, can be provided. Note, instead of arranging a plurality of cleaning units 10, since only one filter box 30 is connected to the terminal end of the main duct 20(20A), the operation of taking out the accumulated flys form the filter box 30 and the cleaning of the filter box 30 can be carried out very easily. Further, since the discharging duct 19 of each cleaning unit 10 is connected to the main duct 20(20A) in such a manner that the longitudinal direction of the discharging duct 19 is inclined to the longitudinal direction of the main duct 20 (20A) at an acute angle with respect to the direction to the filter box 30, the flys can be carried by the air stream discharged from each cleaning unit 10 by using only the air flow created by combining a portion of the air stream discharged from each cleaning unit 10. Namely, it is not necessary to employ an additional blower, and thus the construction of the system for discharging air can be simplified.

We claim:

1. In a spinning machine having (a) spinning frame with a pair of longitudinal beams disposed at either side thereof and extending along the entire length of said spinning machine, (b) a gear end frame at a first end of said spinning machine, (c) an outer end frame at a second end of said spinning machine and a plurality of spring pieces arranged along the length of the machine between said outer end frame and said gear end frame so that said longitudinal beams are rigidly supported by said gear end frame, said outer end frame and said plurality of spring pieces, (d) two alignment of draft parts mounted respectively on said longitudinal beams, wherein the improvement comprises:

a plurality of cleaning units disposed on said machine adjacent to and below said alignments of draft parts, along a longitudinal direction of said spinning machine from said first end to said second end with a first one of said cleaning units being adjacent said first end of said machine and a second one of said cleaning units being spaced downstream therefrom;

a main duct extending along the length of said spinning machine but terminating short of said first cleaning unit, the main duct being under each said cleaning unit except said first cleaning unit, a filter box disposed at said outer end of said spinning frame and connected to a discharge terminal of said main duct for receiving an air stream from said main duct, at least one aperture in a bottom surface of said main duct except in a region between said first and second cleaning units, and a net screen covering said at least one aperture, each of said cleaning units being provided with a suction blower and (b) a suction means extended from said suction blower to at least one group of said draft parts, at each side of said spinning frame, and (c) a discharge duct connecting said suction blower to said main duct, and (d) an electric motor for driving said suction blower, each of said suction means being positioned close to and below a respective group of draft parts, said discharge duct of each one of said cleaning units being connected to said main duct at an acute angle with respect to said bottom of said main duct and oriented in a direction toward said discharge terminal of said main duct, whereby the major part of an air stream discharged from all of said cleaning units is discharged through said bottom aperture of said main duct, while a remaining part of said air stream is discharged from said discharge terminal of said main duct into said filter box, accordingly, the flow resistance in said main duct is restricted to within an allowable range to thereby constantly maintain a uniform cleaning action of said cleaning units.

2. An improved suction cleaning system according to claim 1, including means for selectively opening and closing a portion of said at least one aperture.

3. An improved suction cleaning system according to claim 1, further comprising, means for temporarily cleaning said net screen of said main duct.

4. An improved suction cleaning system according to claim 3, wherein said temporary cleaning means comprises a control circuit applied to at least one of said motors for driving its respective blower at two different driving speeds, whereby, when said blower of said cleaning unit is driven at a second speed higher than a normal driving speed, according to a signal issued from said control circuit, a strong air stream is temporarily created in said main duct so that flys deposited on said net screen are carried thereby to said filter box at said terminal of said main duct.

5. An improved suction cleaning system according to claim 3, wherein said temporary cleaning means comprises a closing plate displaceably disposed below and close to said net screen so that, when said closing plate covers a portion of said net screen, an escape of air through said portion of said net screen is prevented; a mechanism for reciprocally displacing said closing plate between a position close to one end portion of said bottom aperture and a position close to the other end portion of said bottom aperture, along the lengthwise direction of said bottom aperture.

6. An improved suction cleaning system according to claim 3, wherein said at least one bottom aperture is formed with plurality of separated sub-apertures, each one of said sub-aperture is formed in a position between the connected position of two adjacent discharge ducts of two adjacent cleaning units, and a closing plate is pivoted to said main duct at a plurality of positions each facing a corresponding one of said plurality of sub-apertures, and said means for temporarily cleaning said screen net comprises a mechanical means for selectively actuating said closing plates to open or close a corresponding one of said sub-apertures.

7. An improved suction cleaning system according to claim 1, wherein said spinning machine is a spinning frame provided with a spindle alignment at each side of said spinning frame, each of said suction means of at least one of said cleaning units being provided with a branched portion extended to a position close to and behind a corresponding group of said spindles.

* * * * *